United States Patent [19]

Tsukiuda et al.

[11] Patent Number: 4,656,948

[45] Date of Patent: Apr. 14, 1987

[54] WATER CONTAINING EXPLOSIVE CARTRIDGE AND PREPARATION THEREOF

[75] Inventors: Kenji Tsukiuda, Fuji; Yasushi Sasaki, Nobeoka, both of Japan

[73] Assignee: Asahi Engineering Co., Ltd., Osaka, Japan

[21] Appl. No.: 816,837

[22] Filed: Jan. 7, 1986

[30] Foreign Application Priority Data

Jan. 11, 1985 [JP] Japan ..... 60-2667

[51] Int. Cl.[4] ..... F42B 7/02

[52] U.S. Cl. ..... 102/452; 102/289; 102/463; 86/12

[58] Field of Search ..... 102/289, 291, 452, 463; 86/12

[56] References Cited

U.S. PATENT DOCUMENTS

| | | | |
|---|---|---|---|
| 50,536 | 10/1865 | Power | 102/452 |
| 1,913,259 | 6/1933 | Bashford | 102/24 |
| 2,371,874 | 3/1945 | Chapman et al. | 102/24 |
| 2,373,554 | 4/1945 | Finlay | 102/463 X |
| 2,387,665 | 10/1945 | Langkammerer | 102/463 X |
| 2,682,222 | 6/1954 | Richardson et al. | 102/463 X |
| 2,769,377 | 11/1956 | Jennings et al. | 93/55.1 |
| 2,829,595 | 4/1958 | Hitchens | 102/463 X |
| 2,930,275 | 3/1960 | Sentz et al. | 86/1 R |
| 2,996,232 | 8/1961 | Walker | 229/5.5 |
| 3,055,302 | 9/1962 | Bayard et al. | 102/463 X |
| 3,442,214 | 5/1964 | Huskins | 102/463 X |
| 3,678,858 | 7/1972 | Herter et al. | 102/463 X |
| 4,052,939 | 10/1977 | Simmons et al. | 102/24 R |
| 4,167,904 | 9/1979 | Ferri | 102/452 |
| 4,290,365 | 9/1981 | Dreyer | 102/464 X |
| 4,474,715 | 10/1984 | Weber et al. | 102/289 X |

FOREIGN PATENT DOCUMENTS 1533873 11/1978 United Kingdom .

*Primary Examiner*—Peter A. Nelson

[57] ABSTRACT

This invention relates to a water containing explosive cartridge, of which at least one end face is constituted of a star-shaped crimping closure including an inner lid, and a process for producing the same.

4 Claims, 11 Drawing Figures

WATER CONTAINING EXPLOSIVE CARTRIDGE AND PREPARATION THEREOF

BACKGROUND OF THE INVENTION

This invention relates to a water containing explosive cartridge, of which at least one end face is constituted of a star clip portion including an inner lid, and a process for producing the same.

The water containing explosive cartridge is also good in sealability of water containing explosives, having substantially flat end faces rather than being convex at both end faces, particularly at the end face on the sealed side after filling of water containing explosive, and is also suitable for insertion of a detonator.

In recent years, water containing explosives such as water gel explosives, slurry explosives, emulsion explosives are becoming widely used in a large number of fields for industrial explosives, and increased progressively in amounts used in the same fields.

Whereas, as to the wrapped form of such water containing explosives, namely the cartridge is essentially required to have a structure such that the contents will not flow out from the cartridge, because the water containing explosive to be wrapped contains a considerable level of water, and also most of the water containing explosives are in the so called gruel-like state having fluidity. For this reason, sealability is of great concern and, consequently, most of the wrapped products are prepared with the use of a synthetic resin film in the form of the so-called sausage type clipped at both ends.

As a wrapped form different from the sausage type, U.S. Pat. No. 4,033,264 discloses a wrapped product of a water containing explosive with the use of a paper. However, the technique disclosed in U.S. Pat. No. 4,033,264 performs paper wrapping by means of a Rollex wrapping machine (e.g. U.S. Pat. No. 3,248,847) which has been used for wrapping a nitroglycerine-based explosive (dynamite) and, it has been required to select a specific polymer for gel formation and a metal ion for imparting friable or non-cohesive property to the water-bearing gelled explosive which the material to be wrapped. Therefore, the detonation velocity obtained, which is the most important performance of explosive, was only about 2700 m/sec to pose a problem in practical application. Under such a situation, in spite of the proposal of a paper wrapped type as disclosed in U.S. Pat. No. 4,033,264, water containing explosives have been still predominantly in the wrapped form of the sausage type as described above.

The cartridge of this sausage type, while being excellent in water resistance and handling of bench blasting pitfall, has the drawbacks as mentioned below, as compared with the prior type dynamite cartridge:

(1) Since both end faces are crimped with clips, they become convex faces which are poor in continuity of explosion;

(2) Due to convex end faces, detonators can be poorly inserted thereinto and parent dies (cartridges mounted with detonators) can be prepared with difficulty;

(3) Due to convex end faces, overlapping of cartridges will occur within bores during charging of cartridges, whereby charging work can be done with difficulty;

(4) Immense hygroscopic contamination is caused by residual powder at the clip crimping portions during storage.

Various drawbacks as mentioned above are caused primarily by the convex shape of the end faces of the sausage type cartridges, and most of the problems will be overcome if the both end faces can be made end faces consisting of flat planes (hereinafter merely called flat end faces) perpendicular to the longitudinal axis. However, unless the material of the cartridge is made a rigid material, the cartridge will be readily deformable, so long as the contents have fluidity, so that it has been very difficult to seal the cartridge end face, particularly the end face on the side to be sealed as the flat end face in contact with the upper face of the water containing explosive after filling of the water containing explosive.

SUMMARY OF THE INVENTION

The present invention concerns a water containing explosive cartridge with flat end faces, which comprises at least one end face of the cartridge consisting of a star-shaped crimping closure including an inner lid therein. More specifically, the present invention provides a water containing explosive cartridge having substantially flat end faces comprising:

(A) a water containing explosive;

(B) a paper cylinder comprising a paper coated with a resin on at least the face which contacts the water containing explosive, said paper cylinder having a star-shaped crimping closure on at least one end thereof; and (C) a circular inner lid comprising a paper coated with a resin on the outside which does not contact the explosive, said lid being inserted into the innerside of the star-shaped crimping closure portion of said paper cylinder and fixed on said paper cylinder portion or said paper cylinder portion and the star-shaped crimping closure portion.

The cartridge of the present invention comprises (1) a paper cylinder coated at its inner side with a resin and (2) at least one end face of the cylinder is made of a paper coated with a resin and consists of an inner lid and a star-shaped crimping closure portion, which inner lid being fixed onto the paper cylinder portion or the paper cylinder portion and the closure portion, whereby sealability can be maintained at an adequate level and also no hydgroscopic contamination at end portions will occur.

The other end face of the cartridge is also usually constituted of a flat end face with good sealability with a star-shaped crimping closure or by other means, thus giving both end faces which are substantially flat. As the result, no overlapping of cartridges occurs during charging and excellent continuity of explosion can be effected.

Also, a detonator can be inserted at the central part of the star-shaped crimping closure portion without any resistance, and also the inner lid can permit a detonator to be readily inserted due to swelling on the paper side by water absorption, thus enabling insertion of a detonator with extreme ease.

DETAILED DESCRIPTION OF THE INVENTION

The water containing explosive to be used in the present invention is well known in the art, and it contains an oxidizing agent and a fuel in a material such as water which gels a solid in a suspended state, sometimes containing an explosive as the base and being referred to as Water gel explosive or Emulsion explosive in which Slurry explosive, an aqueous phase and an oil, phase are suspended with an emulsifier. These are disclosed in, for example, U.S. Pat. Nos. 343,115, 3,660,181 and 3,447,978.

Figure 1A:
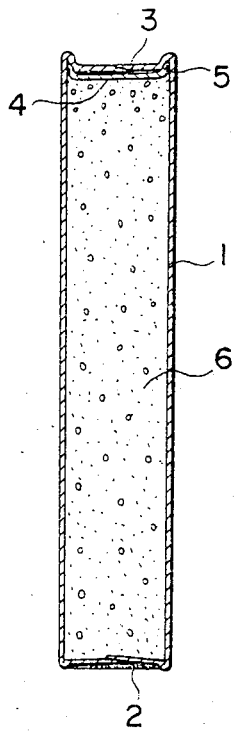
FIG. 1 is an example of the water containing explosive cartridge of the present invention, A indicating a sectional view, B a plan view and C a bottom view.
Figure 1B:
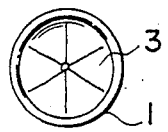
Figure 1C:
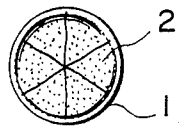
Figure 2A:
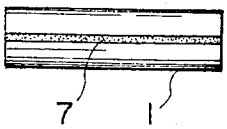
FIGS. 2A–2H are a schematic chart for illustration of the steps for preparation of the water containing explosive cartridge of the present invention.
Figure 2B:
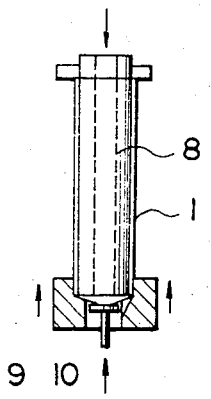
Figure 2C:
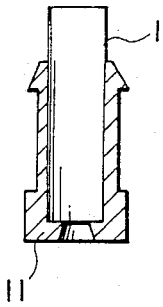
Figure 2D:
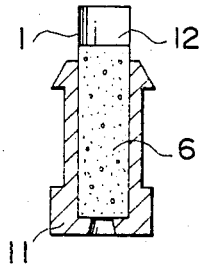
Figure 2E:
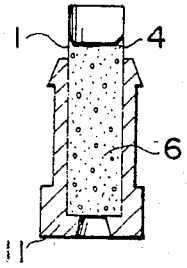
Figure 2F:
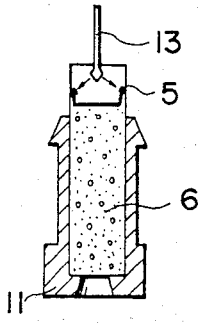
Figure 2G:
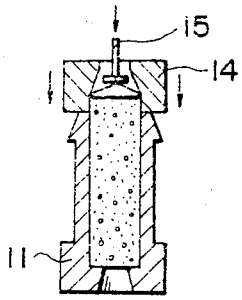
Figure 2H:
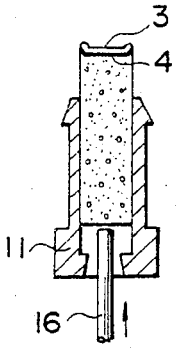

The cartridge of the present invention consists of a paper coated at its innerside with a resin, and is shaped in a cylinder as shown in FIG. 1, with its both end faces being not convex as the sausage type of the prior art, but substantially flat end faces. Here, substantially flat face means that there may be raised portion at the end of the cartridge as shown in FIG. 1, including also the case wherein its central portion is somewhat recessed. One of the end face can be made a sealed flat plane of the known constitution. For example, after the end portion of the paper cylinder is sealed by heat or ultrasonic wave, said sealed portion may be folded in the direction perpendicular to the longitudinal direction of the explosive cartridge and the edge portion is folded toward innerside from the direction of about 90° relative to said folded direction, thereby pressing the end face in the direction of the length of the cartridge. Alternatively, the paper cylinder may be inserted into a paper cylinder holding member to be fixed therein, and the lower end portion is formed in a star-shaped closure with a star-shaped crimping mold while blowing hot air into the paper cylinder from above, followed by actuation of a pressing rod to effect heat sealing of the star clip portion.

The greatest specific feature of the present invention resides in the constitution of the other end face. That is to say, as shown in FIG. 1 (A), the inner lid (4) made of paper coated with a resin contacts the upper face of the water containing explosive (6) at the non-coated face and fixed on the side wall of the cartridge (1) preferably with an adhesive (5). The upper end of the paper cylinder (1) coated on its innerside with a resin is formed into a star-shaped crimping closure outside of the inner lid (4) to thereby constitute the star-shaped crimping closure (3) which becomes the substantially flat end face. In this case, an adhesive may also be used for fixing the folded portion of the star-shaped crimping closure. The inner lid (4) may also be fixed with an adhesive with the star-shaped crimping closure portion (3). Thus, said end face of the cartridge is sealed and substantially flat, and yet it can be made a flat end face without providing a space between the water containing explosive and the end face.

In the following, the respective constitutions are to be described in detail.

The size of the cartridge of the present invention is not particularly limited, but may be ordinarily 25 mm to 35 mm in diameter and 140 mm to 300 mm in length, according to the standard size, also including the sizes outside of said ranges.

As the material for the cartridge, it is required to be capable of forming a star-shaped crimping closure and being folded without immediate return. Also, since it contacts the water containing explosive at least on its innerside, it is required to be resistant to water. In addition, in view of the physical properties of the water containing explosive as well as the size of the cartridge as described above, it should preferably be made primarily of a paper and coated at least on its innerside with a water-resistant synthetic resin. Preferable kinds of papers may any of those which can satisfy the above conditions, as apparent to those skilled in the art, including "Kraft paper" as the primary worked paper, the viscose impregnated paper, the resin impregnated kraft paper, white kraft paper, etc. as the secondary worked paper, particularly preferably Kraft paper from the viewpoint of strength and reliability for long years.

The resin coating of the paper may be a laminate of a film of a thermoplastic resin such as polyethylene, polypropylene, etc., or a coating of a synthetic resin solution or a latex, or otherwise a coating of a thermosetting resin solution. The thickness of the synthetic resin to be coated is not also particularly limited, but a sufficient thickness to impart water resistance and a thinness in the sense to retain foldability of a paper are required. Thus, a thickness of about 10 to 100 $\mu$m is preferred. It is also possible to apply a coating of a water-resistant resin on the outerside of the cartridge, whereby the influence from the external atmosphere such as humidity or water can be avoided.

As a typical example, it is particularly preferable to use a polyethylene-laminated paper having a polyethylene of 15 to 60$\mu$ laminated on one surface or both surfaces of a Kraft paper of 80 to 110 g/m$^2$ (Artlap paper).

The other end face of the cartridge may be any one, provided that it is a flat end face as described above, but it is preferably be made a star-shaped end face as shown in FIG. 1 (C) 2. In the case of having a thermoplastic resin film laminated on a paper heat treatment after formation of the star-shaped crimping closure can readily form a flat end face through thermal fusion mutually between the folded portions.

The star-shaped crimping closure (FIG. 1 (B) and (C)) has conventionally been used for forming the wrapped end face in wrapping of dynamite, etc., and the mold for forming such a star-shaped crimping closure is also well known in the art (e.g. Rollex automatic molding wrapping machine of Fr. Niepmann & Co., as disclosed in U.S. Pat. No. 3,248,847). The number of crimps for the star-shaped crimping closure is not particularly limited, but it may preferably about 5 to 10, more preferably 6 to 8, depending on the size of the cartridge.

The shape of the inner lid is of course circular and may preferably be made to have a diameter slightly greater than the diameter of the cartridge cylinder and inserted with its circumferential portion being somewhat warped. It is inserted and fixed as perpendicular to the longitudinal axis of the cartridge cylinder, as a matter of course.

The material for the inner lid is a paper coated on one surface with a resin. The resin may be the same resin as on the paper cylinder, particularly preferably a laminate of a thermoplastic resin film. The paper should be swellable with water absorption and lose its strength after water absorption, and also have a thickness which is better if it is thinner than that used for the paper cylinder from the viewpoint of inserting working of the inner lid. Particularly preferably, a Kraft paper of 50 to 80$\mu$ laminated with a polyethylene of 15 to 30$\mu$ may be used.

The inner lid is used with the paper side on the explosive side and the resin side on the outer side, the end portion of the inner lid being fixed on the paper cylinder or on the paper cylinder and the star-shaped crimping closure portion. This fixing may be preferably done with the use of an adhesive.

The adhesive for fixing of the inner lid may be any one, provided that it has adhesiveness for both of the paper and the synthetic resin and has no effect on the quality of the water containing explosive, and low temperature heating within this range may be permissible. For example, a paraffin wax, a hot melt such as ethylene-vinyl acetate copolymer, or a mixture of both may be available.

Adhesion between the inner lid and the side wall of the cartridge is not necessarily required to be effected on the entire surface but a point adhesion may be possible. In the case of a point adhesion, hermetic sealing is effected between the inner lid and the star-shaped crimping closure portion on the outside thereof. Adhesion of the closure portion or adhesion between the closure portion and the inner lid should preferably be done with the same adhesive.

The inner lid is important in that it contacts the upper face of the filled water containing explosive, prevents oozing out thereof and makes sealing with a star-shaped crimping closure easier. While it is not easy to seal a readily deformable cartridge with an outer lid, sealing can be easily effected by inserting a slightly greater inner lid into the cartridge to be fixed by adhesion therein and performing a finishing fixing with a star clip.

The inner lid thus inserted and fixed is swelled by water absorption through the influence by the water contained in the water containing explosive to thereby lose the strength inherent in the paper, whereby it has the advantage of being very readily worked when a detonator is inserted at the center of the star-shaped crimping closure, and yet the water containing explosive can be sealed by the synthetic resin layer without flowing out to the outside.

Before filling of the water containing explosive, no inner lid is required at the end portion on the side to be hermetically sealed, but it is also possible to provide such an inner lid. Provision of an inner lid can consolidate the structure of the cartridge. In this case, the inner lid may be subjected to thermal fusion together with the star-shaped crimping closure.

Next, the process for preparing the water containing explosive cartridge of the present invention is to be described.

FIG. 2 (A)-(H) show an example of the steps for preparation of the water containing explosive cartridge of the present invention in the order of the steps.

In (A), a rectangular paper laminated on at least one surface with a synthetic resin film is rounded with the film side as innerside and sealed. 1 represents a paper cylinder and 7 a sealed portion. This cylinder is of the type with both ends being opened.

In (B), a paper cylinder 1 is inserted into a paper cylinder holding member 8 to be fixed therein, and the lower end portion is first formed into a star-shaped crimping closure with a star-shaped crimping mold 9 while blowing hot air into the paper cylinder from above, followed by actuation of the star-shaped pressing rod 10 to heat seal the star-shaped crimping closure, to give a cartridge having a star clip portion 2 as shown in FIG. 1 (C).

As the conditions for heat sealing, a hot air temperature of 150° to 180° C. and a hot air holding time of 1 to 5 seconds will be sufficient for sealing of a paper laminated on one surface and both surfaces with a synthetic resin film.

In (C), there is shown the state in which the cartridge sealed at the lower end is held on a cartridge holding member 11.

In (D), there is shown the state in which the water containing explosive is filled within the cartridge, with the upper space 12 being remained.

In (E), an inner lid 4 having a diameter slightly greater than the inner diameter of the cartridge is inserted onto the upper face of the water containing explosive 6. The inner lid is inserted horizontally and becomes concave in shape with the circumferential portion being warped.

In (F), an adhesive such as a mixture of a paraffin wax and a hot melt is discharged through the nozzle of the adhesive discharging rod 12 to effect adhesion between the inner lid 4 and the cartridge 1.

In (G), after forming quickly a star clip with the use of a star clip mold 13 similarly as in (B), the star-shaped crimping pressing rod 14 is actuated to press the star-shaped crimping closure in the longitudinal direction innerside of the cartridge and give a cartridge with an end face having a slightly recessed portion as shown in FIG. 1 (A). In this case, the adhesive also functions for adhesion of the star-shaped crimping closure, and further for adhesion between the star-shaped crimping closure and the inner lid.

In (H), there is shown the state wherein the cartridge completed is pushed up with a thrusting rod 15.

The water containing explosive cartridge of the present invention, because of having end faces which are substantially flat, are excellent in continuity of explosion, chargeability into bores, free from hygroscopic contamination at end portions and also very good in insertability of detonators, as different from the sausage type cartridge by crimp wrapping of the prior art type. Further, it can be prepared easily and surely.

The present invention is described in more detail by referring to the following Examples, by which the present invention is not limited at all.

PREPARATION EXAMPLE 1

Into a cartridge made of a 80 g/m$^2$ of a Kraft paper coated on its innerside with a 40 $\mu$m polyethylene and on its outside with a 15 $\mu$m polyethylene (both face Artlap paper), having an entire length of 188 mm and a diameter of 25 mm, with the sealed width at the cylinder sealed portion of 5 mm, and having a star-shaped crimping closure portion sealed by heat seal, 100 g of a water containing explosive SUNVEX (MMAN SLURRY EXPLOSIVES) with a specific gravity of 1.1 having the composition as shown below was filled, and an inner lid with a diameter of 38 mm formed of a paper of 100 g/m$^2$ coated on one surface with a synthetic resin was inserted with the paper side on the water containing explosive side. Then, about 1 g of a mixture of 4 parts of a paraffin wax and 1 part of a vinyl copolymer type hot melt (NITTAIT C 220, produced by Nitta Gelatin K.K.) was applied on eight sites of the inner lid, and a star-shaped crimping closure was formed quickly by use of a star-shaped crimping mold and the star-shaped crimp was pressed inwardly in the longitudinal direction of the cartridge by actuation of a star-shaped crimping pressing rod, to give a cartridge with an end face having a slightly recessed portion. Thus, a paper rolled cartridge with both flat end faces of 25 mm in diameter and 175 mm in length could be obtained.

PREPARATION EXAMPLE 2

In the same manner as in Preparation Example 1, into a cartridge made of a paper of 80 g/m$^2$ coated on its inner surface with a 40 μm polyethylene having an entire length of 133 mm and a diameter of 30 mm, with a sealed width of the cylinder sealed portion of 5 mm, and having a star-shaped crimping portion sealed with heat seal, 100 g of a water containing explosive SUNVEX (MMAN SLURRY EXPLOSIVES) with a specific gravity of 1.3 having the composition as shown below was filled, and an adhesive was applied at 4 sites on an inner lid of 38 mm in diameter made of the same paper as the paper cylinder, followed by star-shaped crimping formation, to obtain a paper rolled cartridge with both flat end faces having a diameter of 30 mm and a length of 115 mm.

PREPARATION EXAMPLE 3

In the same manner as in Example 1, into a cartridge made of a paper of 80 g/m$^2$ coated on its inner surface with a 30 μm polyethylene having an entire length of 200 mm and a diameter of 30 mm, with a sealed width of the cylinder sealed portion of 5 mm, and having a star-shaped crimping portion sealed with heat seal, 150 g of an Emulsion explosive (W/O type water containing explosive) with a specific gravity of 1.2 having the composition shown below, and thereafter an inner lid of 38 mm in diameter formed of a paper of 80 g/m$^2$ laminated on one surface with a synthetic resin film was inserted into the paper cylinder with the paper side faced toward the explosive side, followed by coating of about 1 g of a paraffin wax on 8 sites of the inner lid and star-shaped crimping formation. As a result, a paper rolled cartridge with both flat end faces having a diameter of 30 mm and a length of 184 mm could be obtained.

COMPARATIVE EXAMPLES

The results of Comparative tests corresponding to Preparation Examples 1–3 are shown in Table 1. The contents of Comparative Examples 1–3 are as described below.

COMPARATIVE EXAMPLE 1

Clip-fastened film wrapped product of the prior art type (25 mm dia.×100 g).

COMPARATIVE EXAMPLE 2

Paper wrapped cartridge completely sealed at both ends (30 mm dia.×100 g).

COMPARATIVE EXAMPLE 3

Preparation Example 3 having no inner lid (30 mm dia.×100 g).

| Formulation of SUNVEX | Example 1 (specific gravity 1.1) | Example 2 (specific gravity 1.3) |
|---|---|---|
| Monomethylamine nitrate | 25% | 25% |
| Ammonium nitrate | 42% | 42% |
| Sodium nitrate | 15% | 15% |
| Water | 15% | 15% |
| Metallic aluminum powder | 2% | 2% |
| Gua gum | 1% | 1% |
| | 100% | 100% |
| Glass baloon (3M Co., B28/750) | 5% | 1.5% |
| Potassium pyro-antimonate | 0.01% | 0.01% |
| Detoration velocity m/sec (diameter: 30 mm, 20° C.) | 4200 | 4100 |

-continued

| Example 3 | |
|---|---|
| Microcrystalline wax | 2.5% |
| Fluid paraffin | 1.5% |
| Sorbitane monooleate | 2.0% |
| Ammonium nitrate | 70.0% |
| Sodium nitrate | 10.0% |
| Water | 14.0% |
| | 100.0% |
| Glass baloon (3M Co., B28/750) | 5.0% |
| Detoration velocity m/sec (diameter: 30 mm, 20° C. | 4800 |

TABLE 1

| | Sealability | Continuity of explosion | Contamination at ends | Chargeability | Insertability of detonator |
|---|---|---|---|---|---|
| Examples | | | | | |
| 1 | ○ | ◎ | ◎ | ◎ | |
| 2 | ○ | ◎ | ◎ | ◎ | |
| 3 | ○ | ◎ | ◎ | ◎ | |
| Comparative Examples | | | | | |
| 1 | ◎ | Δ | X | X | X |
| 2 | ◎ | ○ | ◎ | ○ | Δ |
| 3 | X | ◎ | Δ | ◎ | ◎ |

Note
◎Good
○ Adequate
Δ Slightly bad
X Bad

We claim:

1. A water containing explosive cartridge having substantially flat end faces comprising:
   (A) a water containing explosive;
   (B) a paper cylinder comprising a paper coated with a resin on at least the face which contacts the water containing explosive, said paper cylinder having a star-shaped crimping closure on at least one end thereof; and
   (C) a circular inner lid comprising a paper coated with a resin on the outside which does not contact the explosive, said lid being inserted into the inner-side of the star-shaped crimping closure of said paper cylinder and fixed on said paper cylinder portion or said paper cylinder portion and the star-shaped crimping closure portion.

2. A water containing explosive cartridge according to claim 1, wherein one end face consists of a star-shaped crimping closure portion including the inner lid therein and the other end face consists of a star-shaped crimping closure.

3. A process for preparing a water containing explosive cartridge, which comprises forming a cylinder coated on at least one surface with a synthetic resin with the inner surface being the synthetic resin surface, sealing one end portion of said cylinder as the flat end face, filling said cylinder with a water containing explosive from the other open and portion, thereafter inserting a circular lid having a resin coating into the upper surface of the water containing explosive, fixing said inner lid onto said cylinder by adhesion with an adhesive, and subsequently fixing said open end portion with a star-shaped crimping closure.

4. A process for preparing a water containing explosive cartridged of claim 3, wherein the flat end face of the paper cylinder initially sealed is formed by fixing a star-shaped crimping closure by fusion of the coated resin.

* * * * *